US006039225A

United States Patent [19]

Zimmerman

[11] Patent Number: 6,039,225

[45] Date of Patent: Mar. 21, 2000

[54] UNUSED HANGER INDICATOR SYSTEM AND METHOD THEREFOR

[76] Inventor: Roger A. Zimmerman, 1560 E. Silver King Rd., Queen Valley, Ariz. 85219

[21] Appl. No.: 09/236,145

[22] Filed: Jan. 22, 1999

[51] Int. Cl.[7] ..... A47G 25/14

[52] U.S. Cl. ..... 223/85; 223/92

[58] Field of Search ..... 223/85, 86; 40/322, 40/301, 302, 669; 116/209

[56] References Cited

U.S. PATENT DOCUMENTS

| | | | |
|---|---|---|---|
| D. 192,845 | 5/1962 | Cohen | 40/322 |
| 249,777 | 11/1881 | Fleur | 116/209 |
| 1,389,266 | 8/1921 | Newton | 40/322 |
| 1,560,682 | 11/1925 | Fitzgerald et al. | 40/669 |
| 1,710,296 | 4/1929 | Clark | 223/85 |
| 1,742,649 | 1/1930 | Eastman | 40/669 |
| 2,398,873 | 4/1946 | Ward | 223/86 |
| 2,710,489 | 6/1955 | Myers, Jr. . | |
| 3,124,284 | 3/1964 | Collum | 223/85 |
| 3,758,974 | 9/1973 | Malmer | 40/322 |
| 4,563,373 | 1/1986 | Barnett . | |
| 4,886,010 | 12/1989 | Stutzman | 116/308 |
| 5,074,445 | 12/1991 | Chen . | |
| 5,499,466 | 3/1996 | House | 40/322 |
| 5,649,653 | 7/1997 | Joseph . | |
| 5,797,527 | 8/1998 | Lam | 223/85 |

*Primary Examiner*—Bibhu Mohanty
*Attorney, Agent, or Firm*—Harry M. Weiss; Jeffrey Weiss; Paul W. Davis

[57] ABSTRACT

An unused hanger indicator system. The unused hanger indicator system, comprises; a structural support point, a hanger suspended from the structural support point and adapted to receive an article, and a weight coupled to the hanger wherein the weight is coupled to the hanger at a point distant from a center of gravity of the hanger. The affect of the weight coupled to the hanger at a point distant from the center of gravity is to cause an end of a hanger so equipped with the weight to tilt the end of the hanger opposite from the weighted end up when the hanger is not constrained to remain level due to the mass of an article hung upon the hanger.

7 Claims, 1 Drawing Sheet

UNUSED HANGER INDICATOR SYSTEM AND METHOD THEREFOR

BACKGROUND OF THE INVENTION

1. Field of the Invention

This invention is in the field of hangers for clothing and other items needing hanging and methods therefor, and more particularly, is a system and method for a hanger system that provides an indication that a hanger is unused.

2. Description of the Related Art

Hangers for clothing, towels, and other articles have existed for a very long time. Today, these hangers come in various shapes and sizes, including triangular hangers mass-produced using metal and plastic materials, and wooden hangers shaped for shirts, suit coats, pants etc. All of these hangers suffer from a severe drawback however. When looking at a rack full of hangers, used and unused, it is very difficult to identify unused hangers buried amidst the used hangers, particularly where a hanger is used to hold something other than a shirt or coat e.g. a pair of pants, shirt, scarf or tie This problem is even more acute when the user is looking down a row of hangers at a parallel angle trying to find an empty hanger hidden among the used hangers.

Therefor a need existed for a system and method of providing a hanger comprising an indicator device that would quickly and easily provide a visual indication that the hanger to which the indicator system is coupled is unused.

Additionally, a need existed for a system of adapting an unused hanger indicator device to be quickly and easily coupled to pre-existing hangers and a method therefor.

SUMMARY OF THE INVENTION

An object of the present invention is to provide a system and method of providing a hanger comprising an indicator device that will quickly and easily provide a visual indication that the hanger to which the indicator system is coupled is unused.

Another object of the present invention is to provide a system and method for adapting an unused hanger indicator device to be quickly and easily coupled to preexisting hangers.

BRIEF DESCRIPTION OF THE PREFERRED EMBODIMENTS

In accordance with one embodiment of the present invention an unused hanger indicator system is disclosed. The unused hanger indicator system comprises; a structural support point, a hanger suspended from the structural support point and adapted to receive an article, and means for visually indicating that the hanger is not in use.

In accordance with another embodiment of the present invention, an unused hanger indicator system is disclosed. The unused hanger indicator system comprises; a weight, coupling tabs coupled to and extending from the weight wherein the coupling tabs are adapted to couple the weight to a hanger at a point distant from a center of gravity of the hanger, wherein the hanger is adapted to receive an article.

In accordance with yet another embodiment of the present invention, an unused hanger indicator method is disclosed. The unused hanger indicator method comprises the steps of; providing a weight, providing coupling tabs coupled to and extending from the weight, and coupling the weight to a hanger at a point distant from a center of gravity of the hanger.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
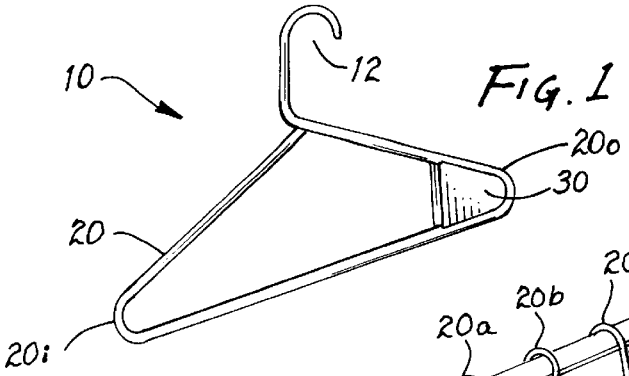
FIG. 1 is a perspective view, of the unused hanger indicator system shown unattached from the support rod of the present invention.

Referring to FIG. 1, a perspective view, of the unused hanger indicator system "the system 10" hereinafter) of the present invention is shown. The system 10, in a referred embodiment, comprises a hanger 20. The hanger 20 is further comprised of two ends, the inboard end 20*i*, and the outboard end 20*o*. The terms "inboard" and "outboard" are meant to provide identification relative to a typical method of placing a hanger on a support rod i.e. inserting a hanger with the hook 12 facing away, or outboard, from the user so as to engage a support rod as the hanger is moved in the outboard direction from the user toward the support rod. Using this convention the end of a hanger 20 on the same side as the hook 12 opening is the outboard end 20*o*, and the opposite end of the hanger is the inboard end 20*i*. Fitted within the crook of the outboard end 20*o* is a weight 30. The weight 30 may be coupled to a hanger in many ways well known to those skilled in the art. Some examples of coupling include, without being limited to, using adhesives, mechanical fastening, or molding to or as part of the hanger 20. (Of course the weight 30 may optionally, though not preferably, be coupled to the inboard end 20*i*.)

Figure 2:
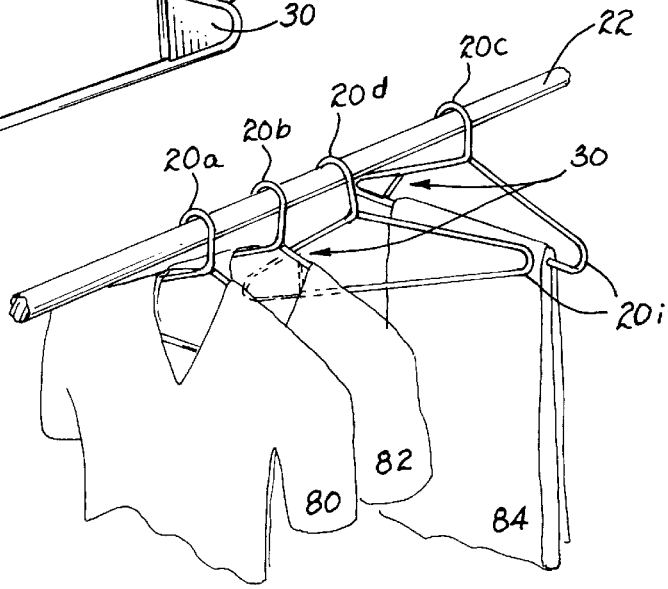
FIG. 2 is a perspective view, of the unused hanger indicator system showing an exemplary usage of the present invention.

Referring to FIG. 2, a perspective view of the unused hanger indicator system showing an exemplary usage of the present invention is shown. In a preferred embodiment of the system 10, hangers 20*a–d* are placed upon a support rod 22. Though a typical support rod is shown herein, this is merely exemplary. Those skilled in the art will recognize that any structural support over which the hook 12 of a hanger 20 may be placed may be suitable for use with the invention of the present system. Additionally, as those skilled in the art are aware, the use of hangers in some locations such as hotel rooms comprises the use of hangers that are coupled with other than a hook 12. Some examples of these alternative hanger coupling methods comprise; hangers that are permanently, rotatably coupled to a support rod (not shown); and hangers that are hung upon a support rod coupling device using a ball appended to the hanger and supported within a socket suspended from the support rod (not shown). The purpose of many of these alternative hanger coupling arrangements is the prevention or discouragement of routine hanger theft. Those skilled in the art will recognize that the actual means of coupling a hanger to a support rod is not limiting in any embodiment of the present invention, an unused hanger indicator system and method therefor.

Continuing with FIG. 2, a support rod 22 is used to provide a support point for hangers 20*a–d*. Typical uses for hangers 20 include shirt or blouse type garments 80 and 82 as are hung on hangers 20*a* and *b*. As is known by the average person, hangers 20 may be used for just about any clothing item including shirts, t-shirts, pants, skirts, coats, scarves, robes, etc. A further use of a hanger is for draping towels or other textile type products such as the cloth 84 draped upon hanger 20*c*. Each of the hangers 20*a–d* are a preferred embodiment of the present invention and comprise a weight 30 coupled to the outboard end 20*o* of each hanger 20*a–d*.

The weight 30 is an important element in the operation of the present invention. The coupling of the weight 30 to a hanger 20, at a point distant from a center of gravity of the hanger 20 causes the hanger 20 to tilt when not balanced by an article 80, 82, or 84 draped upon the hanger 20*a, b*, or *c* (While the weight 30 is preferably proximate an outboard end 20*o*, it could optionally be placed at some other point along the hanger 20 that is distant from the center of gravity of the hanger 20. The weight 30 is designed to have sufficient mass so that the hanger 20 will tilt when unused, but to be light enough so that a typical garment 80, 82, or 84 draped on the hanger 20 *a, b*, or *c* respectively will substantially balance out the mass distribution of the hanger 20 *a, b*, or *c* and its hung item, thus causing the hanger 20 *a, b*, or *c* to hang in a normal fashion parallel to a floor. A weight 30 is coupled to each of the hangers 20*a–d*, though as shown in FIG. 2, the hangers 20, *a, b*, and *c* are draped with articles 80, 82 and 84 are hanging normally, i.e. substantially parallel to the floor, while the hanger 20*d* that is empty has the inboard end 20*i* tilted upward. This upward fit of the inboard end 20*i* enables the quick and easy identification of the unused hanger 20*d*.

Figure 3:
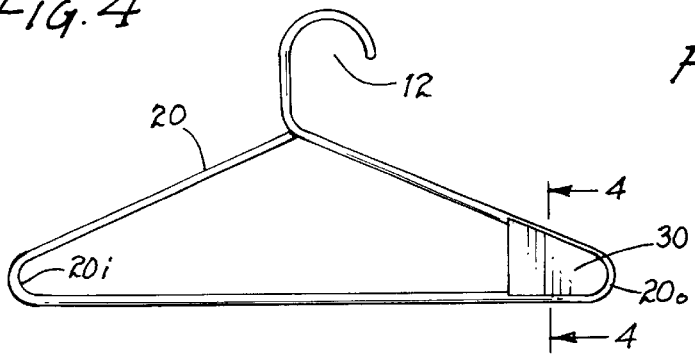
FIG. 3 is a front view, of the unused hanger indicator system of the present invention.

Referring to FIG. 3, a front view of the unused hanger indicator system of the present invention is shown. As previously described, a weight 30 is coupled to the outboard end 20*o* of the hanger 20.

Figure 4:
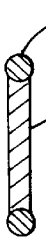
FIG. 4 is a cut-away view, of the unused hanger indicator system of the present invention along the line 4—4 of FIG. 3.

Referring to FIG. 4, a cut-away view of the unused hanger indicator system 10 of the present invention along the line 4—4 of FIG. 3 is shown. In a preferred embodiment of the present invention, a weight 30 is coupled by molding or using adhesives so that, as shown in FIG. 4, the weight 30 is form fitted into the crook of an end of the hanger 20.

Figure 5:
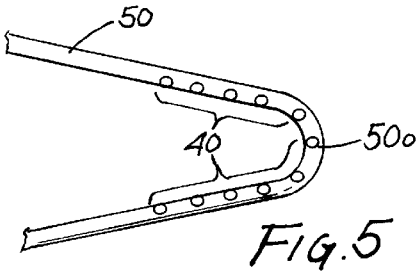
FIG. 5 is a front view, of an first alternate embodiment of the unused hanger indicator system of the present invention.

Referring to FIG. 5, a front view of a first alternate embodiment of the unused hanger indicator system 10 of the present invention is shown. In a first alternate embodiment of the present invention, the weight 40 comprises a set of weights embedded within the material of a hanger 50. The weight 40 set is embedded at the outboard end 50*o* of the hanger 50 in order to achieve the purpose of placing the weight 40 at a point distant from a center of gravity of the hanger 50. Those skilled in the art will recognize that the weight 40 could also comprise a single element of sufficient mass molded or coupled, within or on, any point suitably distant from a center of gravity of a hanger 50.

Figure 7:
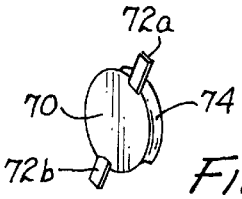
FIG. 7 is a perspective view, of a weight used for a second alternate embodiment the unused hanger indicator system of the present invention.

Referring to FIG. 7 a perspective view of a weight 70 used for a second alternate embodiment of the unused hanger indicator system 10 of the present invention is shown. In this second alternate embodiment, a weight 70 is designed for after-market attachment to pre-existing hangers. The weight 70 comprises coupling tabs 72*a* and *b* for coupling the weight 70 to a hanger. The weight 70 in this embodiment also features a grooved channel 74 circumscribing the perimeter of the weight 70. The grooved channel 74 enhances the coupling of the weight 70 to a hanger by proving a channel that positions the weight 70 securely in the crook of a hanger end.

Figure 6:
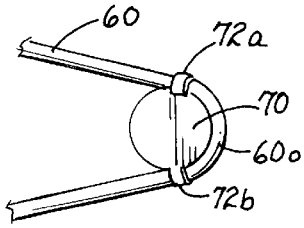
FIG. 6 is a front view, of a second alternate embodiment of the unused hanger indicator system of the present invention.

Referring to FIG. 6 a front view of the second alternate embodiment of the unused hanger indicator system 10 of the present invention is shown in use. The weight 70 has been placed in the crook of the outboard end 60*o* of a hanger 60. The coupling tabs 72*a* and *b* have been wrapped around the hanger 60 body to secure the weight 70 to the hanger 60. Those skilled in the art will recognize that the shape of the weight 70 may be changed herein. For example, the weight 70 could be an elongated rectangular box-shaped device (not shown herein) coupled to the bottom of a hanger outboard end 60*o*, or a u-shaped channel of some suitably massed material (not shown herein) wrapped around, or within, the periphery of the outboard end 60*o* of a hanger 60. These three embodiments, round weight 70, box-shaped device (not shown herein), and u-shaped channel (not shown herein) are by no means the only suitable method of constructing an after-market attachment for pre-existing hangers, but are intended to represent and suggest the wide range of possible adaptations within the scope of the present invention's concept.

Additionally, though not shown herein, the present invention is by no means limited to standard triangle shaped hangers such as hanger 20 of FIG. 3. The present invention may be suitably used upon hangers not having a bottom pants rung, hangers that are straight across in design for hanging pants by gripping of the cuffs or waist, hangers that are shaped for sports or suit coats, etc. The idea of the present invention, is to provide for a hanger system and method that provides a visual indication that a hanger is unused. Also of consideration in regard to the present invention, are alternate high-tech systems and methods meeting the scope and spirit of the present invention, an unused hanger indicator system and method. A high-tech system could comprise, for example, an electrical system coupled to a hanger, sensitive to weight or the presence of a hung article, that in the absence of the article would provide a visual indication via a light emitting source. For example, a lit LED at the tip of an unused hanger would provide visual indication of an unused hanger, and moreover be visible even in a darkened environment. Variations on this theme would include a hanger comprising light and weight sensitive circuits so that an LED would begin flashing on the unused hanger when an overhead light was turned on. This variation would preserve the battery life of the system.

Although the invention has been particularly shown and described with reference to a preferred embodiment thereof, it will be understood by those skilled in the art that changes in form and detail may be made therein without departing from the spirit and scope of the invention.

What is claimed is:

1. An unused hanger indicator system, comprising, in combination:

a structural support point;

a hanger suspended from said structural support point;

wherein said hanger comprises:

an article support having a first side and a second side and outside edge wherein each of said first side and said second side have substantially equal mass;

a member adapted to rotatable couple said hanger to said structural support point and located substantially at a middle point along said hanger between said first side and said second side; and means for visually indicating that said hanger is not in use;

wherein said means comprises:

a weight not extending beyond the outside edges of the hanger coupled to said first side so as to impart greater mass to said first side than to said second side and wherein said weight has sufficient mass to cause said hanger to rotate about said structural support point so as to position said second side higher than said first side when said article is not present on said article support.

2. The system of claim 1 wherein said first side is an inboard side of said hanger.

3. The system of claim 1 wherein said first side is an outboard side of said hanger.

4. The system of claim 1 wherein said hanger is removably coupled to said structural support point.

5. The system of claim 1 wherein said weight is integral to said first side hanger.

6. The system of claim 1 wherein said weight is bound within and substantially circumscribed by an end of said first side of said hanger.

7. An unused hanger indicator system, comprising, in combination:

a structural support point;

a hanger suspended from said structural support point;

wherein said hanger comprises:

an article support having a first side and a second side wherein each of said first side and said second side have substantially equal mass;

a member adapted to rotatably couple said hanger to said structural support point and located substantially at a middle point along said hanger between said first side and said second side; and means for visually indicating that said hanger is not in use;

wherein said means comprises:

a weight coupled to said first side so as to impart greater mass to said first side than to said second side and wherein said weight has sufficient mass to cause said hanger to rotate about said structural support point so as to position said second side higher than said first side when said article is not present on said article support; and folding coupling tabs coupled to and extending from said weight, wherein said coupling tabs are adapted to couple said weight to a hanger at a point along said first side distant from said member adapted to rotatably couple said hanger to said structural support point.

* * * * *